United States Patent [19]

Adler et al.

[11] Patent Number: 4,583,025

[45] Date of Patent: Apr. 15, 1986

[54] AUTOGENERATOR OF BEAMS OF CHARGED PARTICLES

[75] Inventors: Richard J. Adler; Michael G. Mazarakis; Robert B. Miller; Steven L. Shope; David L. Smith, all of Albuquerque, N. Mex.

[73] Assignee: The United States of America as represented by the United States Department of Energy, Washington, D.C.

[21] Appl. No.: 547,279

[22] Filed: Oct. 31, 1983

[51] Int. Cl.[4] ..... H01J 25/00

[52] U.S. Cl. ..... 315/4; 315/5; 315/5.41; 331/79

[58] Field of Search ..... 315/3, 4, 5, 5.41, 5.42; 331/79, 81; 372/2

[56] References Cited

U.S. PATENT DOCUMENTS

| | | | |
|---|---|---|---|
| 3,398,376 | 8/1968 | Hirshfield | 315/5.24 X |
| 3,463,959 | 8/1969 | Jory et al. | 315/5 |
| 3,489,943 | 1/1970 | Denholm | 315/5 |
| 4,143,299 | 3/1979 | Sprangle et al. | 315/5 |
| 4,150,340 | 4/1979 | Kapetanakos et al. | 315/3 |
| 4,215,291 | 7/1980 | Friedman | 315/4 |
| 4,345,220 | 8/1982 | Sullivan | 331/79 |
| 4,453,108 | 6/1984 | Freeman, Jr. | 315/5 |

OTHER PUBLICATIONS

"The Turbutron" A New Gigawatt Source at 35 GHz, by Howard E. Brandt, Proceedings of 2nd National Conference on High Power Microwaves, Mar. 1983, AD-CO31-550, HDL-SR-83-3, pp. 277-284, May 1983.

*Primary Examiner*—Saxfield Chatmon

*Attorney, Agent, or Firm*—George H. Libman; Albert Sopp; Judson R. Hightower

[57] ABSTRACT

An autogenerating apparatus provides secondary intense relativistic current beam pulses in response to an injected beam pulse. One or more electromagnetic energy storage devices are provided in conjunction with gaps along a beam propagation path for the injected beam pulse. For injected beam pulses which are no longer than double the transit time of electromagnetic waves within the storage devices (which may be resonant cavities), distinct secondary beam pulses are generated by each of the energy storage devices. The beam propagation path, together with the one or more gaps provided therein, operates as a pulse forming transmission line cavity, in which the separate cavities associated with the gaps provide delays for electromagnetic waves generated at the gaps. After doubly traversing the cavity, the electromagnetic waves cause the gap to generate the secondary beam pulses, which are thus delayed by a time interval equal to the double transit time for the induced wave within the cavity.

12 Claims, 13 Drawing Figures

FIG. 5
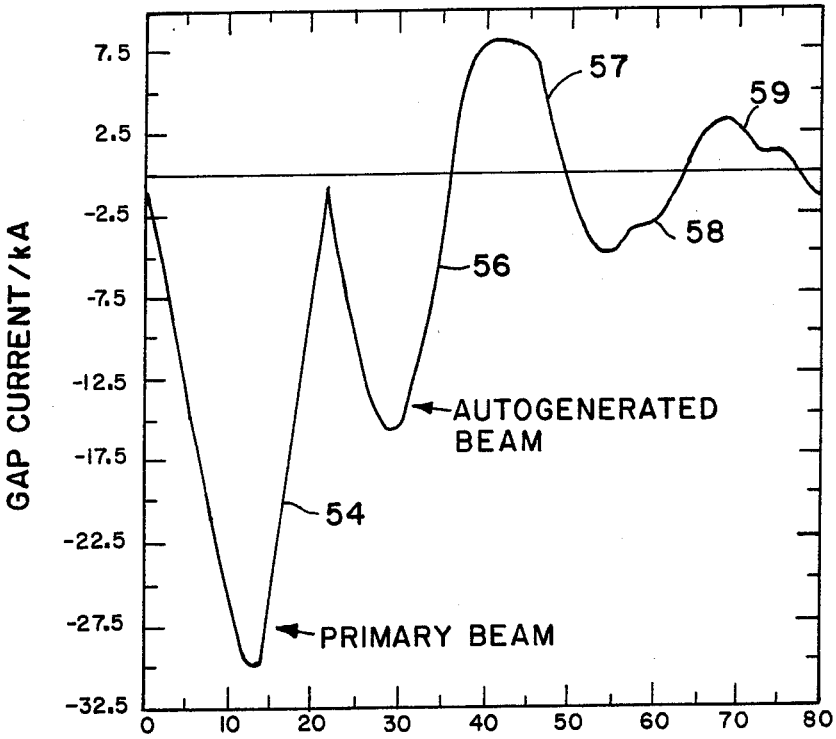
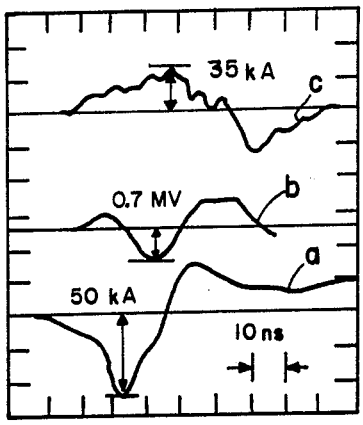
FIG. 6A
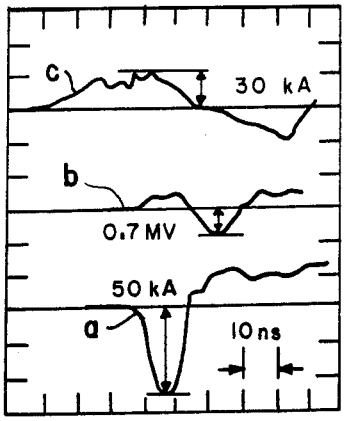
FIG. 6B

AUTOGENERATOR OF BEAMS OF CHARGED PARTICLES

The United States government has rights in this invention pursuant to Contract No. DE-AC04-76DP00789 between the United States Department of Energy and Western Electric Company (41 C.F.R. Section 9-9.109-6(i) (5) (ii) (b)).

BACKGROUND OF THE INVENTION

This invention relates to method and apparatus for generation of plural pulse beams of charged particles, including electrons and other charged particles of heavier mass, and more specifically to such method and apparatus applicable to intense relativistic high energy electron beams.

In the art of acceleration of charged particles and the like, it is known to utilize apparatus incorporating electromagnetic fields for acceleration of such particles. Similarly it is known to utilize apparatus having resonant cavities disposed along a longitudinal trajectory of such charged particles in order to modify the energy distribution of the particles and thus to modify the characteristics of the beam produced thereby.

For example, the use of charged transmission lines as applied to high-current electron accelerators is described in Eccleshall et al., 49 Journal of Applied Physics, 7, July 1978, pp. 3649-3655, as well as in M. Friedman, 31 Physical Review Letters, 18, Oct. 29, 1973, pp. 1107-1110.

In the latter, a foilless diode is utilized in a structure incorporating an electromagnetic coil surrounding a drift chamber and forming therewith an autoaccelerator producing intense relativistic electron beams. An annular electron beam having a current of approximately 10 kiloamperes and a voltage of approximately 500 kilovolts is produced for a duration of approximately 50 nanoseconds. The magnetic field produced by an electromagnetic coil is used to confine spread of the produced electron beam. In the Eccleshall paper there is illustrated the use of resonant cavities, contacting the path of the electron beam, to modify characteristics of the beam current.

Yet a further illustration of the prior art is provided in Friedman U.S. Pat. Nos. 4,038,602 and 4,215,291, and in Miller U.S. Pat. No. 4,070,595, relating to structures for particle acceleration.

None of the prior art references, however, relate to the production of a separate electron beam pulse in response to a primary, or incident, beam pulse. In the prior art disclosures, an externally generated electron current beam pulse is modified with respect to energy distribution and the like, utilizing structure such as resonant cavities, for example. However, various characteristics of the incident beam must remain fixed, and no provision is made for the generation and production of a second, time distinct, intense relativistic electron beam. Such production in the prior art may thus only be achieved by the repeated use of the beam generating structure or by a complex alignment of a plurality of such structures, each producing a separate beam. It is thus difficult to obtain a sequence of high energy high current pulses of charged particles for use in radiographic imaging of rapidly changing objects, for example.

There is thus a need in the prior art to provide a simplified structure for generating sequential intense beams of charged particles, each traversing substantially the same path and separated in time from one another.

SUMMARY OF THE INVENTION

Accordingly, it is a primary object of the present invention to provide method and apparatus for generation of a sequence of separate pulse beams of charged particles.

It is a more specific object of the invention to generate at least one secondary beam of charged particles in response to incidence of a primary beam of charged particles.

It is a further object of the invention to provide a transformation from an incident pulse of an intense relativistic electron beam (IREB) to one or more secondary pulses of IREBs having selectable voltage relationships to the primary beam and a selectable time relationship thereto.

It is another object of the present invention to provide an apparatus for generating a beam of charged particles separate from, yet responsive to, a primary beam of such charged particles, the secondary beam occurring subsequently to, and having different voltage characteristics from, the primary beam.

Yet another object of the invention is the conversion of a single IREB pulse to a plurality of IREB pulses having selected voltage and current characteristics.

Additional objects, advantages and other novel features of the invention will be set forth in part in the description which follows and in part will become apparent to those skilled in the art upon examination of the following or may be learned with the practice of the invention. The objects and advantages may be realized and attained by means of the instrumentalities and combinations particularly pointed out in the appended claims.

To achieve the foregoing and other objects, and in accordance with the purposes of the present invention as described herein, a current beam autogenerator is provided for transforming an IREB pulse to a plurality of such pulses. The inventive autogenerator includes a first beam delivery means for providing a primary, or incident, current beam to the autogenerator. A second beam delivery means is provided for receiving the primary current beam pulse, as well as for receiving the secondary, or autogenerated, current beam pulse from the autogenerator. A gap structure is provided between the first and second beam delivery means for generation of an electromagnetic wave. Finally, a wave energy storage means is connected to the gap for storage of energy associated with the electromagnetic wave generated in response to passage of the primary IREB pulse across the gap structure. The return, or reflected energy of the electromagnetic wave stored in the wave storage means, upon passing across the gap structure, generates a secondary IREB pulse subsequent to termination of the first IREB pulse. In order to provide this relationship, the wave storage means is designed to provide storage for the energy associated with the electromagnetic wave for a time equalling or exceeding the duration of the primary IREB pulse.

The wave storage means may comprise a transmission line or a cavity, of the type having an open end at the gap and a shorted reflecting end displaced therefrom by a distance selected to provide a duration for propagation and reflection through the transmission means or cavity, which time is at least equal to or greater than the pulse duration of the primary IREB pulse. The cavity may be perpendicularly oriented with respect to a longitudinal direction defined by the beam delivery means, although other orientations are within the scope of the invention. Additionally, the cavity may be cylindrically shaped, may be doughnut-shaped, may be annular, or may have other shapes.

Preferably, the second beam delivery means is provided with a larger transverse dimension than the first beam delivery means, in order to be able to receive all the electrons output by the first beam delivery means. The different transverse dimension relates to the cross-sectional area of the two beam delivery means, and may particularly refer to an increased diameter of the inlet of the tubular second beam delivery means with respect to the diameter of the outlet of the tubular first beam delivery means.

In accordance with another aspect of the invention there is provided a method for autogenerating a beam current pulse in response to a primary beam pulse including the steps of providing the primary beam pulse to a gap and generating an electromagnetic wave at the gap in response to the pulse of beam current and thereafter providing a storage means for the generated electromagnetic wave. The energy associated with the electromagnetic wave is stored for a period of time at least equalling or exceeding the duration of the beam current pulse. The stored electromagnetic wave is thereafter provided to the gap for generation of a secondary IREB.

The inventive method may include the steps of providing a transmission line or a cavity for storage of the electromagnetic wave energy, together with reflection of the electromagnetic wave generated in the gap within the transmission line or cavity to return towards the gap at a time at least equalling or exceeding the duration time of the first mentioned IREB pulse.

In order to provide the IREB pulse to the gap, the beam current is preferably transmitted to the gap through a first drift tube having a first transverse dimension, and after passage through the gap the primary IREB pulse is transmitted through a second drift tube having a second transverse dimension larger than the first dimension of the first drift tube in order to channel the primary and any subsequently generated secondary pulses of beam current to the second drift tube.

Still other objects and features of the present invention will become readily apparent to those skilled in this art from the following description wherein there is shown and described the preferred embodiment of the invention, simply by way of illustration of one of the best modes suited to carry out the invention. As will be realized, the invention is capable of still other, different embodiments and its several details are capable of modifications in various obvious aspects, all without departing from the invention. Accordingly, the drawings and the descriptions will be regarded as illustrative in nature and not as restrictive.

BRIEF DESCRIPTION OF THE DRAWINGS

The accompanying drawings, incorporated in and forming a part of the specification, illustrate several aspects of the present invention and, together with the description, serve to explain the principles of the invention. In the drawings:

FIGS. 3A–3G show wave propagation through the structure of FIG. 2 to explain operation of the invention;

FIG. 5 shows a computed gap current for the inventive structure of FIG. 1 illustrating autogeneration of an electron beam; and FIGS. 6A and 6B show results of an experiment verifying the computation of FIG. 5.

Reference will now be made in detail to the present preferred embodiment of the invention, an example of which is illustrated in the accompanying drawing.

DETAILED DESCRIPTION OF THE INVENTION

Figure 1:
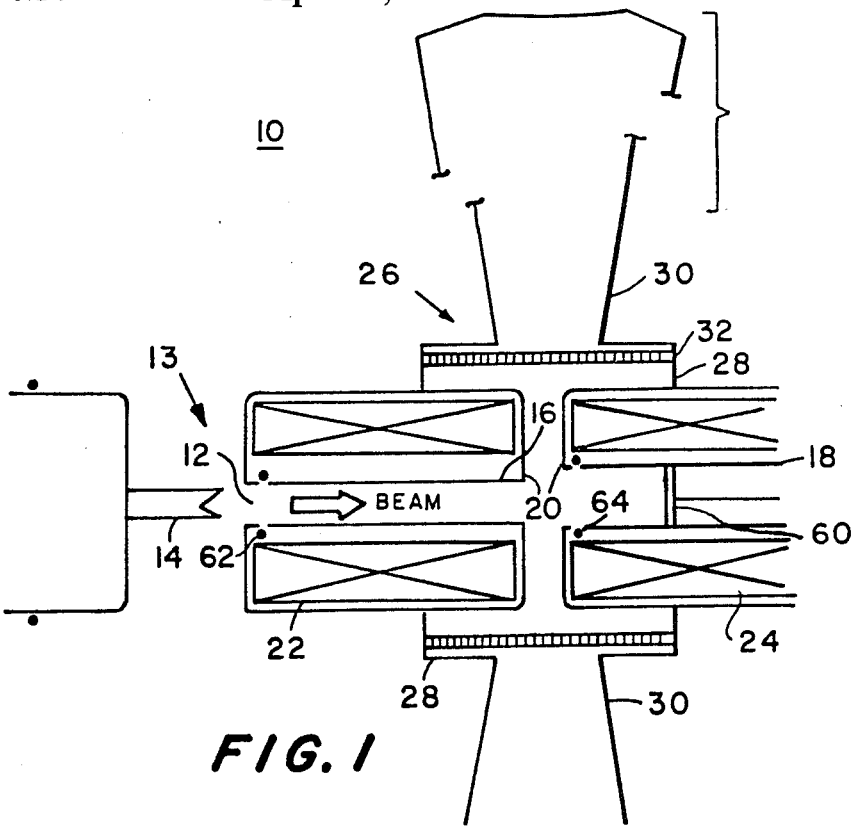
FIG. 1 shows an autogenerator structure incorporating the inventive concept.

Referring now to FIG. 1, there is shown an apparatus operative in accordance with the principles of the invention for generating a plurality of intense beam current pulses in response to a single input beam current pulse, and preferably for operating with relativistic beam current pulses.

The inventive structure, generally shown at 10, includes an inlet 12 for a relativistic beam current pulse generated by a beam generating structure 13 including a foilless diode. The structure includes a cathode 14 and an anode formed by an opening to a primary drift tube 16 at inlet 12.

A secondary drift tube 18 is separated from primary drift tube 16 by a gap 20. Preferably, in accordance with the invention, the inner diameter of secondary drift tube 18 is larger than the inner diameter of primary beam tube 16, particularly in the vicinity of gap 20. Both primary and secondary drift tubes 16 and 18 are shown as having a constant diameter throughout their lengths, but it should be understood that drift tubes having varying cross-sectional areas may be utilized as appropriate, and that the difference in cross-sectional areas is provided at least in the vicinity of the gap and may be similarly provided throughout the lengths of the tubes.

Drift tubes 16 and 18 are surrounded by coil windings 22 and 24, respectively, for generating a magnetic field therein in order to channel and direct flow of electrically charged particles or beams therethrough.

Associated with the gap 20 between the primary and secondary drift tubes is an autogenerating cavity structure 26. The dimensions of the cavity structure are chosen in combination with the dimensions of gap 20, as described in the sequel, in order to provide the desired operation. That is, in response to injection of an intense relativistic electron beam by the foilless diode at inlet 12, gap 20 and the autogenerated cavity structure 26 cooperate to generate a secondary intense relativistic electron beam in the drift tubes.

As illustrated in FIG. 1, the autogenerating cavity structure 26 includes a cylindrical cavity portion 28 surrounding the gap structure and a doughnut-shaped (annular) cavity portion 30. An insulator 32 surrounds the gap region between the two drift tubes.

As will be understood from the following description of operation, the cavity structure is not necessarily confined to utilization of a doughnut-shaped cavity portion 30. Nor is the structure restricted to having a perpendicularly extending cavity, as illustrated by the doughnut-shaped cavity portion 30, which is provided transversely to the longitudinal flow path defined by the electron beam passing through the drift tubes. Instead, a cavity of any shape may be associated with the gap 20, including but not limited to an elongated cylindrical radial cavity, for example, and the cavity portion may project at any angle with respect to the longitudinal direction. Thus, cavity structures of the shape shown in Friedman U.S. Pat. Nos. 4,038,602 and 4,215,291, incorporated herein by reference, wherein a plurality of cylindrical cavities are associated with a plurality of gaps in a drift chamber, may be incorporated in the present structure. To understand operation of the present invention, reference is made to FIGS. 2 and 3A–3G, illustrating an analogous, simplified, representation for the inventive structure of FIG. 1.

Figure 2:
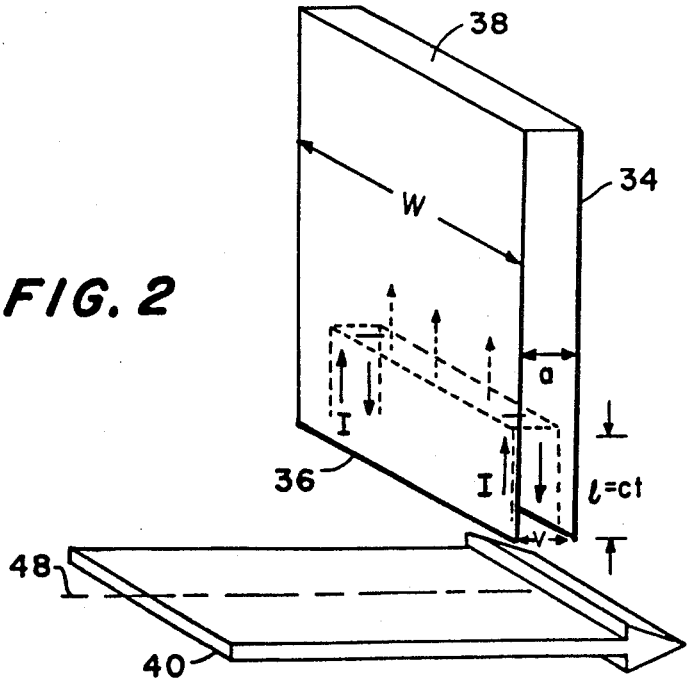
FIG. 2 provides an analogous structure useful in understanding operation of the autogenerator of FIG. 1.

The illustration of FIG. 2 summarizes the mechanism of induction of an electromagnetic wave in a simplified structure of a strip-line transmission line 34. The strip-line has an open end 36 and a shorted termination 38. An electron beam pulse, symbolized by 40, passes in the vicinity of the open end 36 of transmission line 34. The voltage V induced in the gap at the open end 36 of the transmission line is given by the product of the characteristic impedance, $Z_0$, of the transmission line and the beam current of the pulse, I, as derived below.

$$V = \frac{\partial}{\partial t} \int B \cdot dA$$

$$V = \frac{\partial}{\partial t}\left(\frac{\mu 1}{W} al\right)$$

$$\frac{dl}{dt} = c = \frac{1}{\sqrt{\mu\epsilon}}$$

$$V = \mu 1 \frac{a}{W} \frac{dl}{dt}$$

$$V = \sqrt{\frac{\mu}{\epsilon}} \frac{a}{W} 1 = Z_0 1$$

An electromagnetic wave is thus generated within the transmission line, travelling as current moving along the wall of the transmission line. The electromagnetic wave, upon reaching the shorted termination 38 of the transmission line, is reflected back towards the open end 36 thereof. To understand the machanism by which a secondary intense relativistic electron beam is generated by the inventive structure, reference is made to FIGS. 3A–3G, wherein T represents the length of time necessary for the electromagnetic wave travelling along the transmission line to traverse the entire length L thereof.

In FIG. 3A there is shown propagation of the induced electromagnetic wave through the strip line during the interval 0−T, wherein E represents the electric field of the electromagnetic wave at the open end of the transmission line, and is induced by the current beam pulse thereat. FIG. 3B illustrates the wave position at time t=T, wherein the electromagnetic wave has fully traversed the full length of the transmission line. Thereafter, the electromagnetic wave is reflected by the shorted termination 38 of the transmission line with a reversed field direction, as shown at FIG. 3C. In FIG. 3C there are shown two waves which coexist in the transmission line, but which for clarity are shown separately. FIG. 3C represents the wave condition of the transmission line during the time interval T to 2T, wherein the reflected wave is propagating in its return toward the open end of the transmission line.

At time T=2T the reflected wave reaches the open end of the transmission line, as shown at FIG. 3D. For the period of time between 2T and 3T the wave condition within the transmission line includes an overlapping of three waves, as shown in FIG. 3E. The right-going primary wave induced by the beam pulse is shown at 42, while the left-going wave reflected by the shorted termination of the transmission line is shown at 44. After time t=2T, the wave is again reflected at the open end 36 of the transmission line, the twice reflected right-going wave is shown at 46. As is known, the wave reflected at the shorted termination undergoes a reversal of polarity while that reflected at the open end maintains its field orientation and polarity in the same direction.

Thus, it is seen that a field is induced in the transmission line in the form of a wave front propagation. The induced wave is continuously being produced at the open end of the transmission line for so long as the beam current pulse is present at the open end. At the time t=2T shown in FIG. 3D there is zero combined field at the open end gap of the transmission line, but the cavity or transmission line is filled with electromagnetic energy obtained from the beam current pulse. Thereafter, in the situation shown at FIG. 3E, although no primary beam is present at the gap, the energy stored within the cavity results in a potential difference at the open end having a polarity to accelerate electrons in the same direction as initially provided in the primary beam pulse. The cavity thus acts as an accelerating source, akin to a foilless diode, having a net field at its gap equal to twice the original field.

By terminating the beam pulse generated by the foilless diode at time t=2T, the situation shown in FIG. 3E persists until t=3T at which time the direct wave has disappeared and a thrice reflected wave has appeared. Until t=4T, the induced voltage at the open end of the transmission line remains as shown in FIG. 3E. Thus, for a period of time equal to 2T, the time necessary for the end of the direct wave induced by the pulse of beam current to traverse the length of the transmission line twice (i.e., from open to shorted ends and return), there will be generated at the open end of the transmission line the double strength, reverse direction electric field which is of a polarity and magnitude capable of generating an electron beam.

Figure 3F:
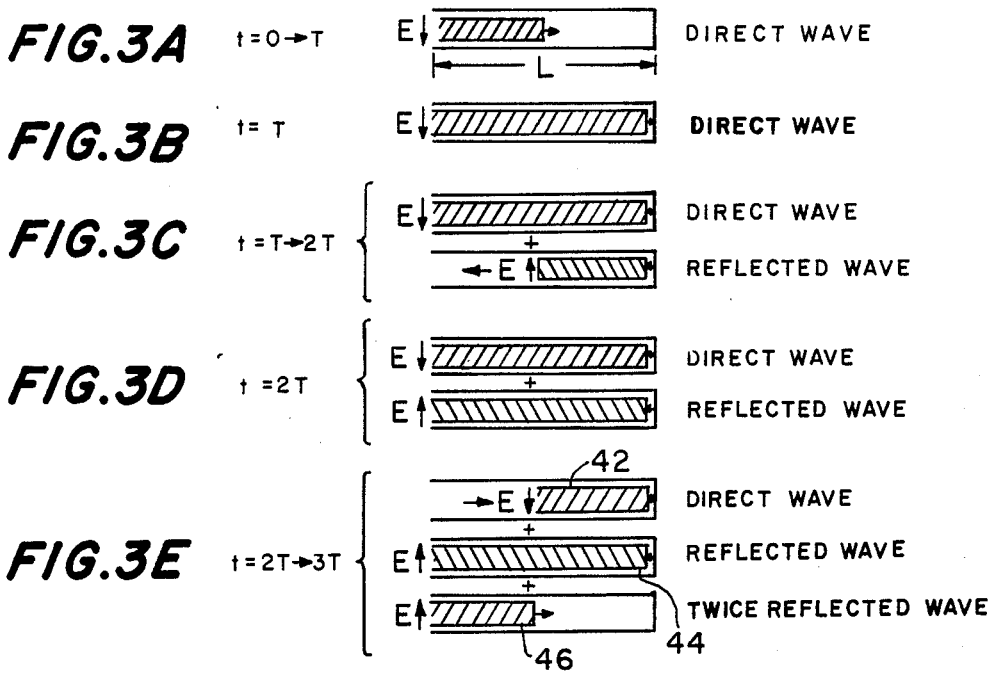

An idealized form of the pulse shape for the primary beam current necessary to perform the invention is shown in FIG. 3F, wherein the current pulse is shown to have a magnitude $-I_0$ and a duration of 2T. It should be recognized that the pulse may, but need not, have a duration exactly equal to 2T. If the pulse has a duration of $T+t_i$, then the condition of FIG. 3E will persist for a time $t_i$. That is, the pulse is presumed to have a duration sufficiently long to enable the presence at the open end of the transmission line of twice the induced voltage and in an opposite direction. At the same time, the pulse duration should be no greater than 2T to assure that a time separation exists between the end of the direct, primary pulse and the beginning of the secondary, autogenerated pulse. For a pulse duration of 2T, the voltage induced at the open end, or gap, of the transmission line is shown in FIG. 3G, and is illustrated as being equal to $Z_0I_0$ for the time period 0−2T, and as being equal to $-2Z_0I_0$ for the time period 2T to 4T.

By variation of the physical characteristics of the open end or gap, the characteristic impedance of the gap may be made different from the characteristic impedance of the cavity, $Z_0$, thus producing a different accelerating voltage at its open end, and permitting generation of a secondary pulse of beam current having any predetermined voltage or current characteristics.

As will be appreciated from the foregoing analysis, the induced gap voltage will oscillate and further reversals and changes in magnitude therein will be provided. However, the initial potential reversal, resulting in the negative gap voltage between the times 2T and 4T, is utilized to generate a secondary pulse of beam current, in the same direction as the primary pulse, and with a time separation which depends on the time of termination of the primary pulse.

If the primary beam current pulse in fact has a duration of 2T, it is seen that virtually no time separation may be expected between the primary and secondary beam pulses. However, for beam pulses which are shorter than 2T by an amount $T_o$, it is seen that the secondary pulse, which will be generated at a time 2T, will be separated in time from the primary pulse by a spacing of $T_o$. Moreover, the secondary pulse itself, which has as duration substantially identical with that of the primary pulse, will be shorter than 2T by the amount of $T_o$.

From the foregoing it should be understood that the inventive structure operates in two modes. During a first mode, illustrated by the time 0 to 2T in FIGS. 3A to 3D, the gap seen by the electron beam acts to decelerate the beam. During this phase of operation, in which the induced voltage appears across the gap and tends to slow down the beam, energy is given up by the pulse of beam current and is launched into the cavity. Thus, no additional electron emission results.

Figure 4:
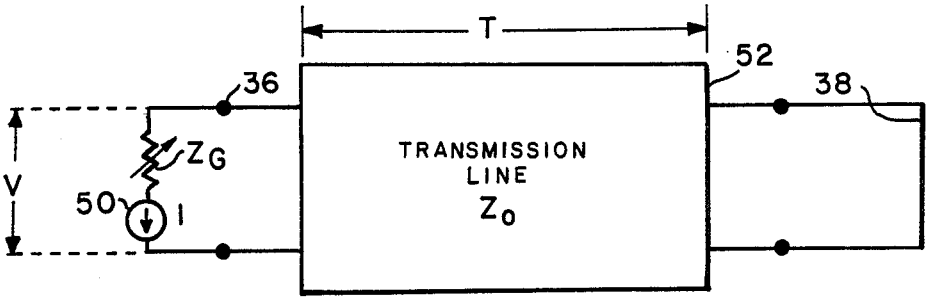
FIG. 4 is of interest in providing yet a further analogous circuit for understanding operation of the invention.

During the acceleration, or autogeneration, phase of operation, however, illustrated by times subsequent to 2T, the cavity and gap function as a foilless diode to generate the secondary beam current pulse. Referring thus to FIG. 4, there is shown a circuit diagram representing operation of the inventive structure. Specifically, the voltage V appearing across the gap as shown in FIG. 2 is labelled in FIG. 4. The gap is represented by a variable impedance $Z_g$ and a current source 50. The cavity 26 is represented by a block 52 labelled as a transmission line having a characteristic impedance $Z_0$, and having a shorted termination 38. At time t=2T, as soon as the autogenerated pulse starts, the impedance of the gap foilless diode, identified at $Z_D$, becomes the load and the voltage on the gap decreases and is given by $V_{AUTOG}=2I_0(Z_DZ_0/[Z_D+Z_0])$.

For a situation where the effective diode impedance $Z_D$ is much greater than the value $Z_0$, it is seen that the autogenerated voltage in accordance with the preceding equation becomes equal to the product $V_{AUTOG}=-2I_0Z_0$ as shown in FIG. 3G. The amount of current produced thereby becomes equal to the autogenerating voltage divided by the diode impedance $Z_D$, which is reduced from the beam current pulse magnitude. Nonetheless, the kinetic energy of the autogenerated beam can, in principle, be adjusted at will in the range of 0–2$E_0$, where $E_0$ is the kinetic energy of the primary beam. However, the current I and the kinetic energy E of the autogenerated beam pulse must of course obey the relationship $I_o \times E_o = I \times E$.

Where a plurality of cavities are used in a radial line accelerator (radlac) structure, such as illustrated in Miller et al., *Multi-Stage Linear Electron Acceleration Using Pulse Transmission Lines*, J. Appl. Phys. Vol. 52, No. 3, March 1981, pp. 1184–1186, a plurality of secondary beams may be generated. Each of the associated cavities, or radial pulse lines, generates a separate secondary beam. Where the $i^{th}$ cavity generates an $i^{th}$ beam having a kinetic energy $E_I$ and a current $I_I$, the autogenerated electron beam pulses obey the relationship $$I_o \times E_o = \sum_i I_i E_i$$

representing a conservation of the energy provided in the primary beam.

Thus, use of a structure incorporating multiple autogenerating cavities which may each provide different electromagnetic wave transit times therein, results in a train of intense electron beam pulses having particular time distributions and intensities. The intensity of each of the autogenerated beams may be of the order of magnitude of the primary beam. Effectively, the invention thus provides a transformation of an input beam pulse having a proper duration to one or more output beams, having selectable current or kinetic energy values, and conforming to the conservation of energy principle illustrated by the previously described summation.

Alternatively, the invention can be viewed as providing a cavity, transmission line, or other electromagnetic wave storage device, for storing energy associated with a pulse of beam current therein. The cavity, or the like, is chosen to have a storage time, as determined by the time necessary to traverse its dimensions, which is at least equal to, or longer than, the duration of the pulse of beam current, thereby to provide generation of a secondary pulse and a possible spacing between the primary and secondary pulses.

It is also seen from the foregoing description that the specific shape of the cavity used to store the electromagnetic energy associated with the current beam pulse may be varied without altering operation of the inventive structure, and that the specific orientation of the cavity or other storage device with respect to the direction of travel of the beam is not a crucial determination for operability of the invention. Thus, the illustrative simplified structure shown in FIG. 2 may be rotated about axis 48 of the electron beam pulse, providing a cylindrical rather than doughnut-shaped cavity to perform the inventive autogeneration. Moreover, inclination of the wave storage structure of FIG. 2 at an angle other than 90° in the longitudinal direction with respect to axis 48 results in still further configurations applicable for performance of the inventive concept.

Figure 3F:
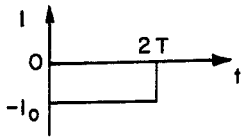
Figure 3G:
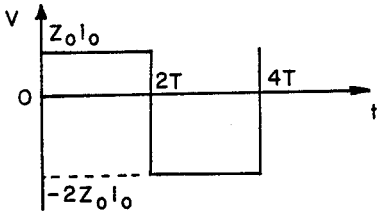

Although the analysis associated with FIGS. 2 and 3 is based on an ideal waveform, wherein a square primary beam pulse is assumed to induce a square retarding voltage at the gap and, thereafter, to generate a square secondary beam pulse, practicable current pulse generation techniques result in current pulses having triangular shapes. A numerical simulation of the inventive process and structure, utilizing a circuit solver code known as "SCEPTRE", has been performed on such a triangular primary beam, and the results are shown in FIG. 5.

Referring to the figure, a triangular primary beam 54, representing a 30 kA, 20 ns pulse is assumed to be input to the inventive structure. The computed current downstream of the autogenerating gap, for an assumed line impedance of 20 ohms and a gap impedance of 50 ohms, is seen to have an oscillatory component, including an initial secondary pulse 56 having a magnitude of approximately 15 kA and a duration somewhat shorter than that of the primary beam. The secondary beam pulse is seen to be generated in the same direction as the primary pulse. However, continuing oscillation may be provided, as illustrated by the successively decreasing amplitude pulses 57, 58, 59, etc. shown in the figure. It is recognized that the pulses 57 and 59, and any additional pulse having a positive polarity in the figure, represent electron beam pulses propagating from right to left in the inventive structure. Such beam pulses, which are generated by the larger circumference of the inlet to the secondary drift tube 18 will lie outside the smaller circumference of the outlet of primary drift tube 16, and thus will not pass therethrough. Finally, the remaining beam pulse illustrated at 58, of the appropriate polarity to pass from the primary to the secondary drift tubes, represents a second or higher order autogenerated current pulse. However, the amplitudes thereof are so diminished as to make these pulses of little consequence. In addition, the simulation produced current oscillations higher than the second autogenerated pulse of FIG. 5. These current oscillations do not appar in practice since the remaining electric field E across the gap is usually below the 150 kV/cm threshold necessary to produce current in the foilless diode 20.

The computational prediction of FIG. 5 is borne out by experimental results utilizing the structure of FIG. 1. Specifically, the foilless diode injector shown in FIG. 1 was used to produce a 3 MeV 20 ns 50 kA electron beam inside a 12 kG guiding magnetic field. The beam pulse was passed through gap 20 located on the axis of the radial line cavity, and impinged on a witness target 60. Target 60 was placed in the structure for experimental verification purposes only, and does not necessarily form part of the invention when used to generate the desired intense electron beams. The experimental structure utilized a secondary drift tube having an inner diameter of 5 cm, compared to the diameter of the primary drift tube of 4.2 cm. The difference in tube diameters creates a foilless diode geometry in which the tip of the upstream tube acts as the cathode shank. The experimental structure provides for propagation of the induced electromagnetic wave within the transmission line, reflection at the shorted edge thereof, and return to the gap 16 ns later. At that time, the primary beam will have cleared the gap and the voltage applied to the gap by the reflected wave will have created a second, thin annular electron beam having a radius substantially equal to that of the upstream beam tube. Because of the different radius envelopes of the primary and the autogenerated beams, the imprints thereof on the witness target as actually observed were easily distinguishable.

Characteristic results for two of the experiments performed on the structure are shown in FIGS. 6A and 6B. In each of the figures, curve "a" represents the injector beam, or primary current pulse as measured by a Rogowski current monitor immediately downstream from the injector 13 of FIG. 1 and shown at 62. A resistive voltage monitor measured the voltage induced across the autogenerating gap, the resulting voltage is shown at curve "b" of FIGS. 6A and 6B. Finally, a second Rogowski current monitor, located at 64 in FIG. 1, was used to measure the gap beam current (curve "c").

As is apparent from the experimental results, the primary current pulse is not a square pulse but is, in fact, more closely related to the triangular pulse utilized in FIG. 5 to provide computed results for the inventive structure. The trailing end of the primary pulse thus is superimposed in time with the beginning of the autogenerated pulse, which displays a peak approximately 15 ns after the peak of the primary pulse. Additionally, in accordance with the predicted value, the pulse peak of the autogenerated pulse was observed to be approximately 60%–70% of the peak amplitude of the primary pulse.

These results are more completely described in Mazarakis et al., *Intense Electron Beam Autogenerator*, IEEE Trans. on Nuclear Science, Vol. NS-30, No. 4, August 1983, pp. 3171–3173, incorporated herein by reference.

Observation of a witness target 60 utilized in the inventive structure confirms the provision of two imprints, due to the primary and secondary, or autogenerated, beam pulses. A small radius imprint was observed, due to the primary beam generated by the injector cathode having a shank of approximately 2.5 cm diameter. A larger radius imprint was also observed, representing the larger diameter autogenerated beam.

There has thus been disclosed a method and apparatus for providing a plurality of relativistic electron beam current pulses in response to a single injected current pulse. The beam pulses may be provided to a further accelerating structure, or may be used to irradiate a target for the production of X-ray images which may be used in radiography to photograph quickly varying phenomena. Different structures may be utilized to realize the invention, and beams of charged particles other than electrons may similarly be affected upon appropriate variation of accelerating voltages, magnetic field strength, device dimensions, etc.

Sufficient magnetic field strength should be provided by the coil windings illustrated at 22 and 24, for example, to assure that the beam will not oscillate in the radial direction. Additionally, the gap dimensions should be chosen such that a virtual cathode will not appear therein. Specific computations in this regard may be formulated in accordance with the teachings of *Introduction to the Physics of Intensely Charged Particle Beams*, R. B. Miller, Plenum, 1982.

The foregoing description of the preferred embodiment of the invention has been presented for purposes of illustration and description. It is not intended to exhaust or to limit the invention to the precise form disclosed. Obvious modifications or variations are possible in light of the above teaching. The preferred embodiment was chosen and described to provide the best illustration of the principles of the invention and its practical application, thereby to enable one of ordinary skill in the art to utilize the invention in various embodiments and with various modifications as are suited to the particular use contemplated. It is intended that the scope of the invention be defined by the claims appended hereto.

We claim:

1. A current beam autogenerator comprising:

first beam delivery means for providing a first current beam pulse, said means including an outlet of a first cross-sectional area;

second beam delivery means having an inlet of a second cross-sectional area larger than said first cross-sectional area, said means being coupled to said outlet of said first beam delivery means across a gap;

wave storage means, having an input coupled to said gap, for storing all energy associated with an electromagnetic wave for a time equal to or greater than the pulse duration time of said first current beam, said electromagnetic wave being induced across said gap when said first current beam pulse passes said gap;

whereby said second beam delivery means receives a second current beam pulse autogenerated in the gap when the stored energy is emitted from the input of said wave storage means after termination of said first current beam pulse.

2. A current beam autogenerator as recited in claim 1 wherein said first and second beam delivery means comprise drift tubes.

3. A current beam autogenerator as recited in claim 2 wherein, said inlet of said second beam delivery means tube has a larger diameter than said outlet of said first beam delivery means tube.

4. A current beam autogenerator as recited in claim 1 wherein said wave storage means comprises wave transmission means having an open end at said gap means and a shorted reflecting end displaced from said open end by a distance selected to provide a wave propagation and reflection time therethough equal to or greater than the pulse duration time of said first beam current pulse.

5. A current beam autogenerator as recited in claim 4 wherein said wave transmission means comprises a autogenerating cavity.

6. A current beam autogenerator as recited in claim 5 wherein said autogenerating cavity is perpendicularly oriented with respect to a longitudinal direction defined by said first and second beam delivery means.

7. A current beam autogenerator as recited in claim 5 wherein said autogenerating cavity is doughnut shaped.

8. A method for autogenerating a beam current pulse comprising the steps of:

(a) providing a pulse of beam current to a gap;

(b) generating an electromagnetic wave at said gap responsively to said pulse of beam current;

(c) providing a storage means for said electromagnetic wave;

(d) sorting all energy associated with said generated electromagnetic wave for a time equal to or greater than the duration of said pulse of beam current;

(e) receiving said stored electromagnetic wave at said gap at a time subsequent to passage of said pulse of said beam current through said gap; and (f) generating a current beam at said gap in response to arrival thereat of said stored energy associated with said electromagnetic wave.

9. A method for autogenerating a beam current pulse as recited in claim 8 wherein said step of providing a storage means for said electromagnetic wave comprises the step of providing a transmission line means in communication with said gap and said storing step comprises the step of reflecting said generated electromagnetic wave within said transmission line means back towards said gap at a time equal to or greater than half the duration time of said first mentioned pulse of beam current.

10. A method for autogenerating a beam current pulse as recited in claim 8 wherein said step of providing a storage means for said electromagnetic wave comprises the step of providing a autogenerating cavity in communication with said gap and said storing step comprises the step of reflecting said generated electromagnetic wave within said autogenerating cavity back towards said gap at a time equal to or greater than half the duration time of said first mentioned pulse of beam current.

11. A method for autogenerating a beam current pulse as recited in claim 8 wherein said step of providing a pulse of beam current to the gap comprises the steps of transmitting said pulse of beam current through a first drift tube, having a first transverse dimension, to said gap and, after passage of the pulse through said gap, transmitting said pulse of beam current to a utilizing apparatus through a second drift tube.

12. A method for autogenerating a beam current pulse as recited in claim 11 wherein said step of transmitting said pulse of beam current to a utilizing apparatus through a second drift tube comprises the step of providing said second drift tube a second transverse dimension corresponding to and greater than said first transverse dimension of said first drift tube, thereby channeling said pulse of beam current from said first drift tube to said second drift tube.

* * * * *